US007893914B2

(12) United States Patent
Park

(10) Patent No.: US 7,893,914 B2
(45) Date of Patent: Feb. 22, 2011

(54) LIQUID CRYSTAL DISPLAY DEVICE INCLUDING GATE VOLTAGE OUTPUT UNIT AND METHOD OF DRIVING THE SAME

(75) Inventor: Jung-Sik Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1107 days.

(21) Appl. No.: 11/636,676

(22) Filed: Dec. 11, 2006

(65) Prior Publication Data

US 2008/0001900 A1 Jan. 3, 2008

(30) Foreign Application Priority Data

Jun. 28, 2006 (KR) ..... 10-2006-058508

(51) Int. Cl.
*G09G 3/36* (2006.01)

(52) U.S. Cl. ..... 345/100

(58) Field of Classification Search ..... 345/87–100
See application file for complete search history.

(56) References Cited

U.S. PATENT DOCUMENTS

| | | | | |
|---|---|---|---|---|
| 5,945,970 | A * | 8/1999 | Moon et al. | 345/92 |
| 6,084,580 | A * | 7/2000 | Takahashi et al. | 345/211 |
| 6,421,038 | B1 * | 7/2002 | Lee | 345/98 |
| 7,342,561 | B2 * | 3/2008 | Hiraki et al. | 345/87 |
| 7,375,718 | B2 * | 5/2008 | Kim | 345/100 |
| 2002/0015017 | A1 * | 2/2002 | Kwag | 345/89 |
| 2005/0285840 | A1 * | 12/2005 | Jang et al. | 345/100 |
| 2006/0290640 | A1 * | 12/2006 | Park | 345/98 |

* cited by examiner

*Primary Examiner*—Alexander S Beck
*Assistant Examiner*—Rodney Amadiz
(74) *Attorney, Agent, or Firm*—McKenna Long & Aldridge LLP

(57) ABSTRACT

A display device includes $n^{th}$ and $(n+1)^{th}$ gate lines in a display panel, wherein a pixel electrode of a pixel corresponding to the $(n+1)^{th}$ gate line overlaps the $n^{th}$ gate line; and a gate driver including a gate voltage output unit that outputs an on-level gate voltage and first and second off-level gate voltages to the $n^{th}$ gate line, wherein the on-level gate voltage is outputted during a charging period of the $n^{th}$ gate line, and the second off-level gate voltage is outputted during a charging period of the $(n+1)^{th}$ gate line.

21 Claims, 5 Drawing Sheets

LIQUID CRYSTAL DISPLAY DEVICE INCLUDING GATE VOLTAGE OUTPUT UNIT AND METHOD OF DRIVING THE SAME

This application claims the benefit of Korean Patent Application No. 2006-058508, filed on Jun. 28, 2006, which is hereby incorporated by reference for all purposes as if fully set forth herein.

BACKGROUND OF THE INVENTION

1. Field of the Invention

The present invention relates to a liquid crystal display device, and more particularly, to a liquid crystal display device and method for driving the same.

2. Discussion of the Related Art

Until recently, cathode-ray tubes (CRTs) have been widely used as display-devices. Presently, much effort is being made to study and develop various types of flat panel displays, such as liquid crystal display (LCD) devices, plasma display panels (PDPs), field emission displays (FED), and electro-luminescence displays (ELDs), as a substitute for CRTs. These flat panel displays have been driven by an active matrix driving method in which a plurality of pixels arranged in a matrix configuration are driven using a plurality of thin film transistors therein. Among these active matrix type flat panel displays, liquid crystal display (LCD) devices and electroluminescent display (ELD) devices are widely used for notebook computers and desktop computers because of their high resolution, ability to display colors and superiority in displaying moving images.

In general, an LCD device includes two substrates that are spaced apart and face each other with a layer of liquid crystal molecules interposed between the two substrates. The two substrates include electrodes that face each other such that a voltage applied between the electrodes induces an electric field across the layer of liquid crystal molecules. The alignment of the liquid crystal molecules changes in accordance with the intensity of the induced electric field, thereby changing the light transmissivity of the LCD device. Thus, the LCD device displays images by varying the intensity of the electric field across the layer of liquid crystal molecules.

FIG. 1 is a schematic view illustrating an LCD device according to the related art.

Referring to FIG. 1, the LCD device includes a liquid crystal panel 1 and a driving circuit. The driving circuit includes gate and data drivers 2 and 4.

A liquid crystal panel 1 includes a plurality of gate lines GL1 to GLn and a plurality of data lines DL1 to DLm crossing each other to define a plurality of pixels. Each pixel includes a thin film transistor T, a liquid crystal capacitor Clc and a storage capacitor Cst. The liquid crystal capacitor Clc includes a pixel electrode, a common electrode and a liquid crystal layer between the pixel and common electrodes. The storage capacitor Cst includes the pixel electrode and a previous gate line as two storage electrodes.

A data driver 4 supplies data voltages to the data lines DL1 to DLm. A gate driver 2 supplies gate voltages to the gate lines GL1 to GLn.

On-level gate voltages are sequentially applied to the gate lines GL1 to GLn to enable the gate lines GL1 to GLn and the thin film transistors connected to the gate lines GL1 to GLn. When the thin film transistors T are turned on, the data voltages are applied to the pixels through the data lines DL1 to DLm. A common voltage Vcom is applied to the common electrode. Accordingly, an electric field is applied to the liquid crystal and the light transmissivity of the liquid crystal layer changes, thereby displaying images.

A power supply 6 generates driving voltages for the driving circuit and the common voltage Vcom for the liquid crystal panel 2.

FIG. 2 is a schematic view illustrating a connection between a liquid crystal panel and a driving circuit according to the related art.

Referring to FIG. 2, a data driver (4 of FIG. 1) includes a plurality of data drive ICs 14*a* gate driver (2 of FIG. 1) includes a plurality of gate drive ICs 12*a*. The plurality of the ICs 14*a* are ormed on a plurality of data TCP (tape carrier package) films 14*b* and the plurality of gate drive ICs 12*a* are formed on a plurality of gate TCP films 12*b*. The data drive IC 14*a* is connected to the liquid crystal panel 10 and a PCB (printed circuit board) 16 through the data TCP film 14*b* with a TAB (tap automated bonding) method, and the gate drive IC 12*a* is connected to the liquid crystal panel 10 through the gate TCP film 12*b* with a TAB method. Alternatively, the data and gate drive ICs 14*a* and 12*a* may be directly formed on the liquid crystal panel 10 with a COG (chip on glass) method.

The data and gate drive ICs 14*a* and 12*a* are supplied with data signals and control signals through signal lines on the PCB 16. To do this, the data TCP film 14*b* is directly connected to the PCB 16, and the gate TCP film 12*b* is connected to the PCB 16 through a plurality of LOG (line on glass) lines 11 located along a peripheral portion of the liquid crystal panel 10. The LOG lines 11 connects the gate TCP film 12*b* and the data TCP film 14*b* to transfer signals for the gate drive ICs 12*a*.

The LOG lines 11 include source voltage (Vdd and Vcc) lines, a ground (GND) line, a gate enable (GOE) signal line, a gate start pulse (GSP) line, a high-level gate voltage (VGH) line and a low-level gate voltage (VGL) line.

To turn on/off the thin film transistors (T of FIG. 1), the gate drive IC 12*a* supplies the high/low-level (on/off-level) gate voltages to the gate lines according to a timing sequence.

FIG. 3 is a circuit diagram illustrating pixels according to related art.

Referring to FIG. 3, a storage capacitor Cst of each pixel uses a previous gate line as a storage electrode.

When a high-level gate voltage is supplied to an $(n+1)^{th}$ gate line GLn+1 for an $(n+1)^{th}$ charging period (horizontal scanning period), data voltages are charged to the storage capacitors Cst on the corresponding horizontal line i.e., an $(n+1)^{th}$ horizontal line. The data voltages charged to the storage capacitors Cst ripples due to a variation of a low-level gate voltage supplied to the previous gate line GLn during the $(n+1)^{th}$ charging period. This may generate a flicker and degrade the image quality of the LCD device.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a liquid crystal display device and method for driving the same that can improve display quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device includes $n^{th}$ and $(n+1)^{th}$ gate lines in a display panel, wherein a pixel electrode of a pixel corresponding to the $(n+1)^{th}$ gate line overlaps the $n^{th}$ gate line; and a gate driver including a gate voltage output unit that outputs an on-level gate voltage and first and second off-level gate voltages to the $n^{th}$ gate line, wherein the on-level gate voltage is outputted during a charging period of the $n^{th}$ gate line, and the second off-level gate voltage is outputted during a charging period of the $(n+1)^{th}$ gate line.

In another aspect, a method of driving a display device includes outputting an on-level gate voltage and first and second off-level gate voltages to a $n^{th}$ gate line which overlaps a pixel electrode of a pixel corresponding to the $(n+1)^{th}$ gate line, wherein the on-level gate voltage is outputted during a charging period of the $n^{th}$ gate line, and the second off-level gate voltage is outputted during a charging period of the $(n+1)^{th}$ gate line.

In another aspect, a liquid crystal display device includes $n^{th}$ and $(n+1)^{th}$ gate lines in a liquid crystal panel, wherein a pixel electrode of a pixel corresponding to the $(n+1)^{th}$ gate line overlaps the $n^{th}$ gate line; and an on-level transistor inputted with an on-level gate voltage and connected to the $n^{th}$ gate line; a first off-level transistor inputted with an off-level gate voltage and connected to the $n^{th}$ gate line; and a second off-level transistor inputted with an output voltage of a buffer and connected to the $n^{th}$ gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, example of which are illustrated in the accompanying drawings.

Figure 1:
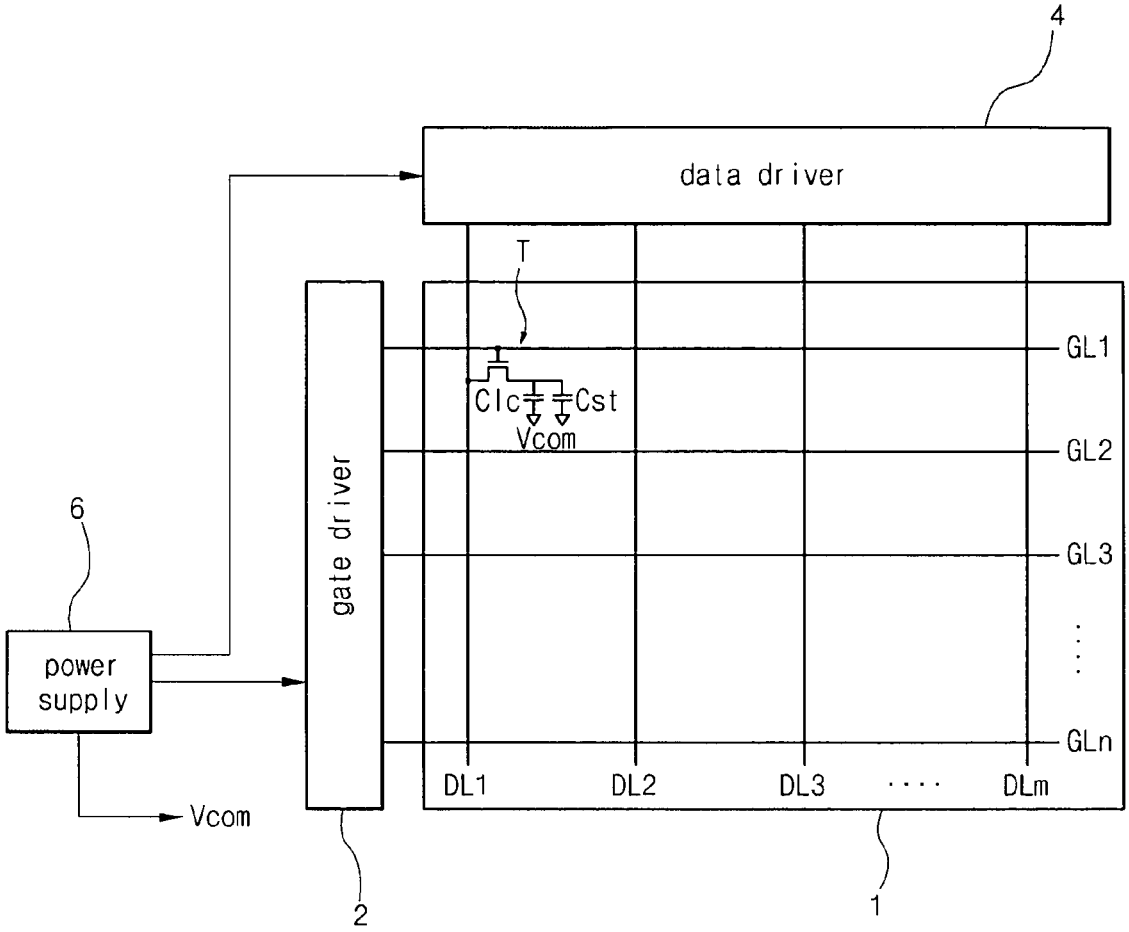
FIG. 1 RELATED ART
FIG. 1 is a schematic view illustrating an LCD device according to the related art.
Figure 3:
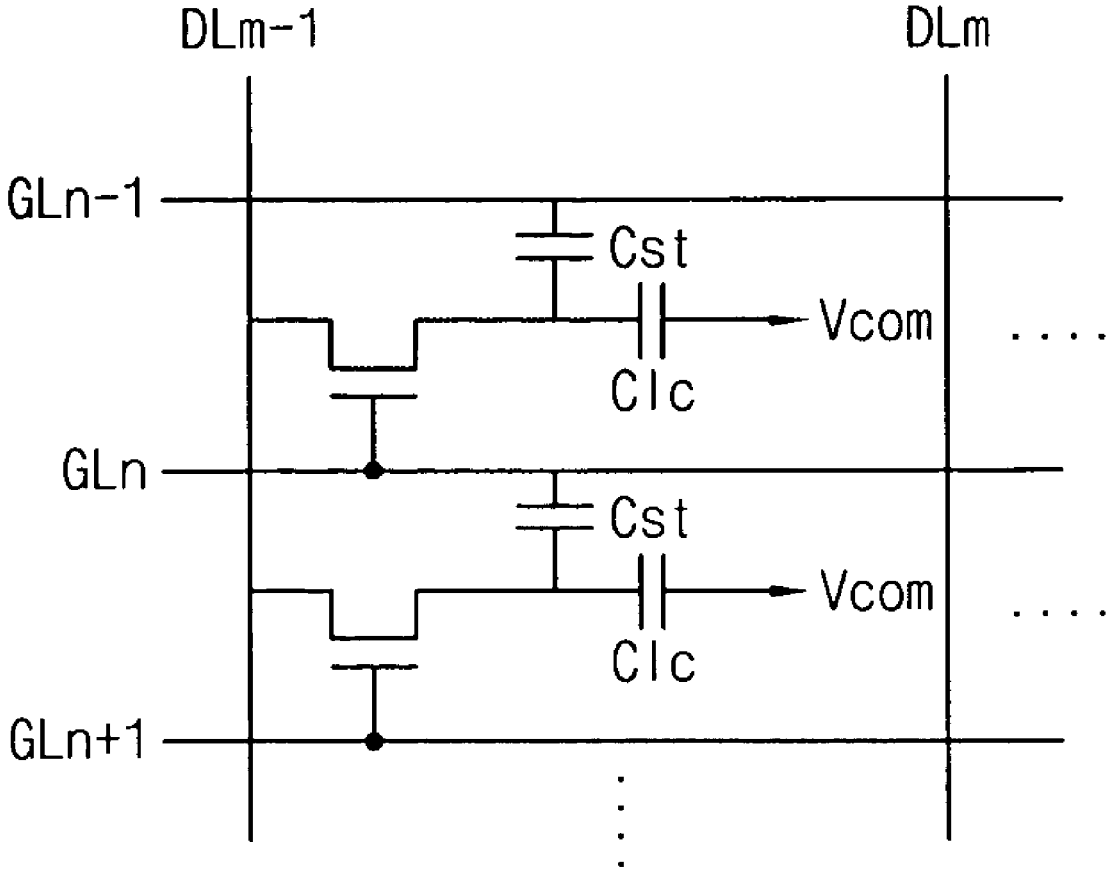
FIG. 3 RELATED ART
FIG. 3 is a circuit diagram illustrating pixels according to related art.
Figure 4A:
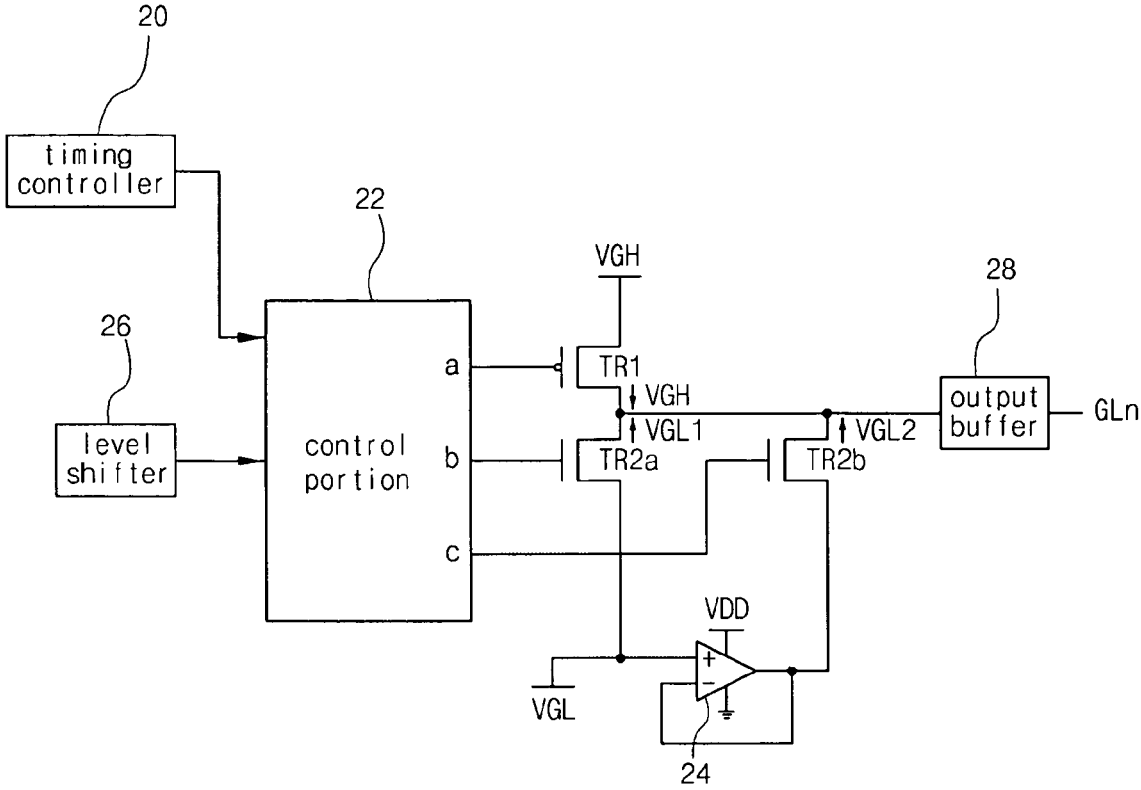
FIG. 4A is a circuit diagram illustrating a gate driver of an LCD device according to an embodiment of the present invention.

FIG. 4A is a circuit diagram illustrating a gate driver of an LCD device according to an embodiment of the present invention. The LCD device of FIG. 4A is similar to that of FIGS. 1-3, except for a gate driver. Accordingly, explanations of similar parts are omitted.

Referring to FIG. 4A, the gate driver includes a plurality of gate voltage output units, each of which includes a shift resistor (not shown), a level shifter 26, a control portion 22, a high-level switching portion TR1, a low-level switching portion TR2*a* and TR2*b*, a buffer 24 and an output buffer 28. Each gate voltage output unit is connected to a corresponding gate line GLn. In addition, a timing controller 20 is connected to the gate driver and supplies a plurality of signals.

The high-level switching portion TR1 includes a high-level (on-level) transistor TR1. The low-level switching portion TR2*a* and TR2*b* includes first and second low-level (off-level) transistors TR2*a* and TR2*b* connected in parallel. The high-level transistor TR1 may be a p-type transistor, for example, a P-MOS transistor. The first and second low-level transistors TR2*a* and TR2*b* may be an n-type transistor, for example, an N-MOS transistor. Both the high-level transistor TR1 and the first low-level transistor TR2*a* may be a single C-MOS transistor.

Figure 2:
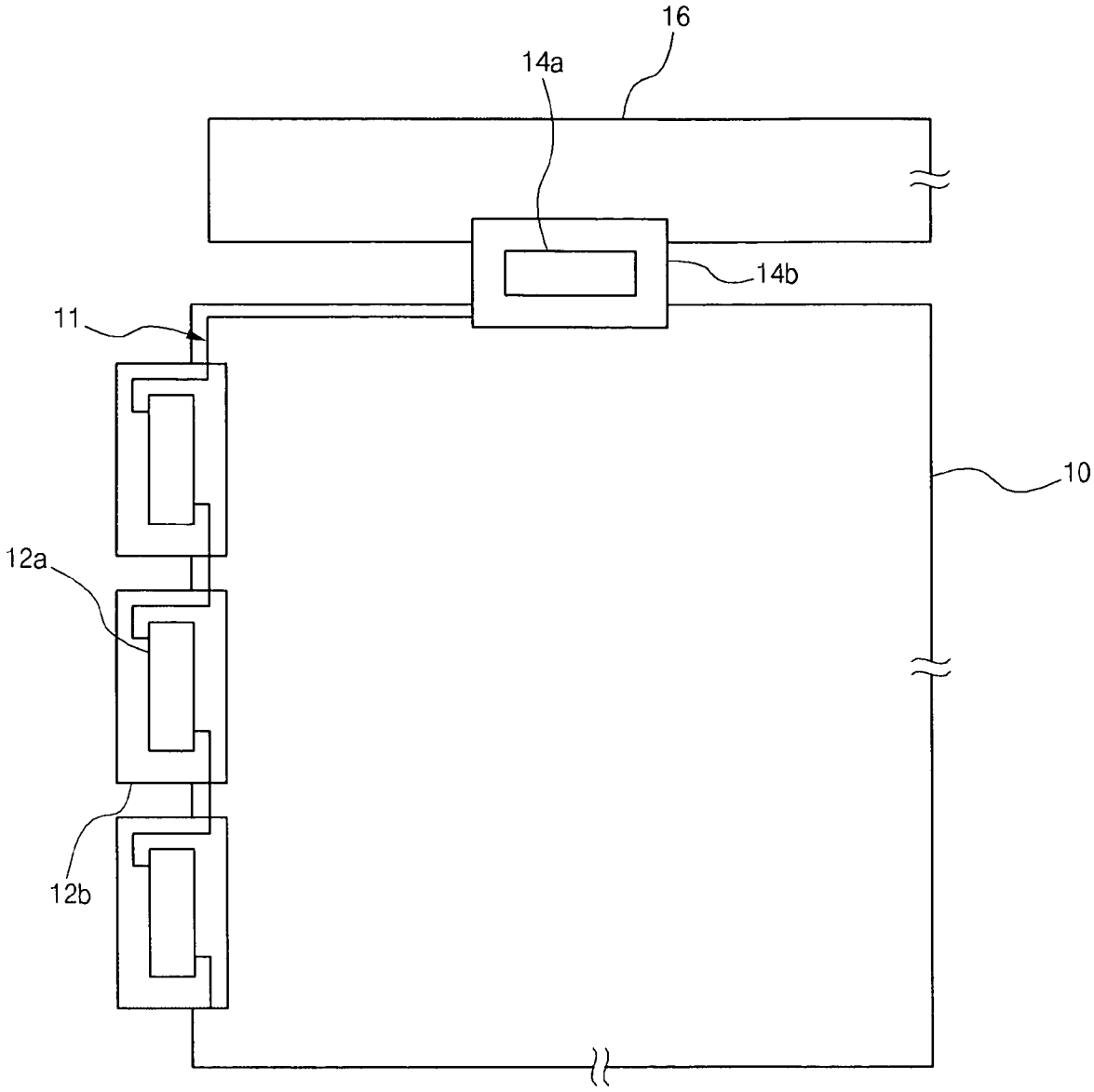
FIG. 2 RELATED ART
FIG. 2 is a schematic view illustrating a connection between a liquid crystal panel and a driving circuit according to the related art.

A source terminal of the high-level transistor TR1 is connected to a high-level gate voltage (VGH) LOG line (11 of FIG. 2). A source terminal of the first low-level transistor TR2*a* is connected to a low-level gate voltage (VGL) LOG line (11 of FIG. 2). A source terminal of the second low-level transistor TR2*b* is also connected to the low-level gate voltage (VGL) LOG line (11 of FIG. 2) through the buffer 24. Drain terminals of the high-level transistor TR1 and the first and second low-level transistors TR2*a* and TR2*b* are commonly connected to the corresponding gate line GLn through the output buffer 28 for stabilization of output voltages.

The control portion 22 is supplied with control signals such as an off-level voltage control signal from the timing controller 20 in a PCB (16 of FIG. 2) through a data TCP film (14*b* of FIG. 2), control signal LOG lines (11 of FIG. 2) and a gate TCP film (12*b* of FIG. 2). The control portion 22 includes first to third output terminals a, b and c connected to gate terminals of the high-level transistor TR1 and the first and second low-level transistors TR2*a* and TR2*b*, respectively. The level shifter 26 may be connected to the control portion to supply a gate signal.

The control portion 22 outputs first to third switching signals to the first to third output terminals a to c according to the control signals. The first to third switching signals turn on/off the high-level transistor TR1 and the first and second low-level transistors TR2*a* and TR2*b*, respectively. During the operation of the gate driver, the high-level transistor TR1 and at least one of the first and second low-level transistors TR2*a* and TR2*b* are selectively turned on. For example, during an $n^{th}$ charging period (horizontal scanning period), the high-level transistor TR1 is turned on, and both the first and second low-level transistors TR2*a* and TR2*b* are turned off. During an $(n+1)^{th}$ charging period, the high-level transistor TR1 is turned off and the second low-level transistor TR2*b* or both the first and second low-level transistors TR2*a* and TR2*b* are turned on. During a frame period excluding time assigned for the $n^{th}$ and $(n+1)^{th}$ charging periods, the high-level transistor TR1 and the second low-level transistor TR2*b* are turned off and the first low-level transistors TR2*a* is turned on.

In FIG. 4A, the high-level transistor TR1 and the first low-level transistor TR2*a* are separately connected to the output terminals a and b of the control portion 22. Alternatively, the high-level transistor TR1 and the first low-level transistor TR2*a* may be commonly connected to the same output terminal of the control portion 22, as illustrated in FIG.

4B. In such a case, the high-level transistor TR1 and the first low-level transistor TR2*a* are alternatively turned on and off.

The buffer 24 includes a voltage follower using an OP-AMP (operational amplifier). A non-inverting terminal (+) is inputted with a low-level gate voltage VGL and an inverting terminal (−) is inputted with an output voltage. Accordingly, the output voltage follows the input voltage by the output voltage feed-back at the buffer 24.

A method of driving an LCD device according to an embodiment of the present invention is explained with reference to FIGS. 4A and 4B.

Referring to FIG. 4A, prior to the charging period of the $n^{th}$ gate line ($n^{th}$ charging period), the control portion 22 corresponding to the $n^{th}$ gate line GLn outputs the first and second switching signals of a high-level from the first and second output terminals a and b and the third switching signal of a low-level from the third output terminal c. Accordingly, the high-level transistor TR1 is turned off, the first low-level transistor TR2*a* is turned on, and the second low-level transistor TR2*b* is turned off. Therefore, a first low-level gate voltage VGL1 is outputted to the $n^{th}$ gate line GLn. The first low-level gate voltage VGL1 is the low-level gate voltage VGL.

During the charging period of the $n^{th}$ gate line GLn, the control portion 22 outputs the first switching signal of a low-level and the second and third switching signals of a low-level. Accordingly, the high-level transistor TR1 is turned on, the first and second low-level transistors TR2*a* and TR2*b* are turned off. Therefore, a high-level gate voltage VGH is outputted to the $n^{th}$ gate line GLn.

During the charging period of the next gate line i.e., a $(n+1)^{th}$ gate line, the control portion 22 outputs the first switching signal of a high-level, the second switching signal of a low-level and the third switching signal of a high-level. Accordingly, the high-level transistor TR1 and the first low-level transistor TR2*a* are turned off, and the second low-level transistor TR2*b* is turned on. Therefore, a second low-level gate voltage VGL2 is outputted to the $n^{th}$ gate line GLn. The voltage level of the second low-level gate voltage VGL2 is the same as the low-level gate voltage VGL. Because the input of the buffer 24 responds to voltage changes of the output of the buffer 24 and produce a corresponding output voltage, the second low-level gate voltage VGL2, the $n^{th}$ gate line GLn is supplied with the low-level gate voltage VGL with a lesser rippling effect, even when a storage capacitor is formed by a pixel electrode and a previous gate line overlapping each other.

Alternatively, during the charging period of the next gate line, the control portion 22 outputs the first switching signal of a high-level, the second switching signal of a high-level and the third switching signal of a high-level. Accordingly, the high-level transistor TR1 is turned off, and the first and second low-level transistors TR2*a* and TR2*b* are turned on. Therefore, the first and second low-level gate voltages VGL1 and VGL2 are simultaneously outputted to the $n^{th}$ gate line GLn to minimize the rippling effect (or capacitance coupling effect).

After the charging period of the next gate line, the control portion 22 outputs the first switching signal of a high-level, the second switching signal of a high-level and the third switching signal of a low-level. Accordingly, the high-level transistor TR1 and the second low-level transistor TR2*b* are turned off, and the first low-level transistor TR2*a* is turned on. Therefore, the first low-level gate voltage VGL1 is outputted to the $n^{th}$ gate line GLn.

As a result, the $n^{th}$ gate line GLn has the high-level gate voltage VGH during the $n^{th}$ charging period, the second low-level gate voltage VGL2 or the first and second low-level gate voltages VGL1 and VGL2 during the $(n+1)^{th}$ charging period, and the first low-level gate voltage VGL1 during a frame period excluding time assigned for the $n^{th}$ and $(n+1)^{th}$ charging periods.

Figure 4B:
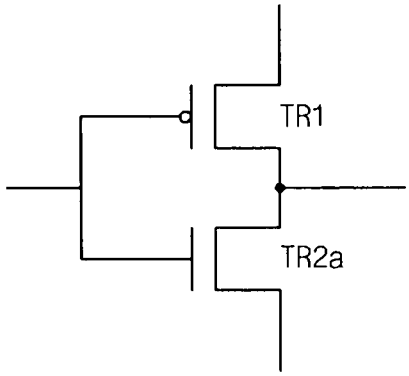
FIG. 4B is a circuit diagram illustrating a high-level transistor and a first low-level transistor connected to the same output terminal of a control portion according to an embodiment of the present invention.

Regarding the LCD device of FIG. 4B, because the high-level transistor TR1 and the first low-level transistor TR2*a* are connected to the same output terminal, the first low-level gate voltage VGL1 is outputted during a frame period excluding time assigned for the $n^{th}$ charging period. Accordingly, the first and second low-level gate voltages VGL1 and VGL2 are simultaneously outputted during the $(n+1)^{th}$ charging period.

Figure 5:
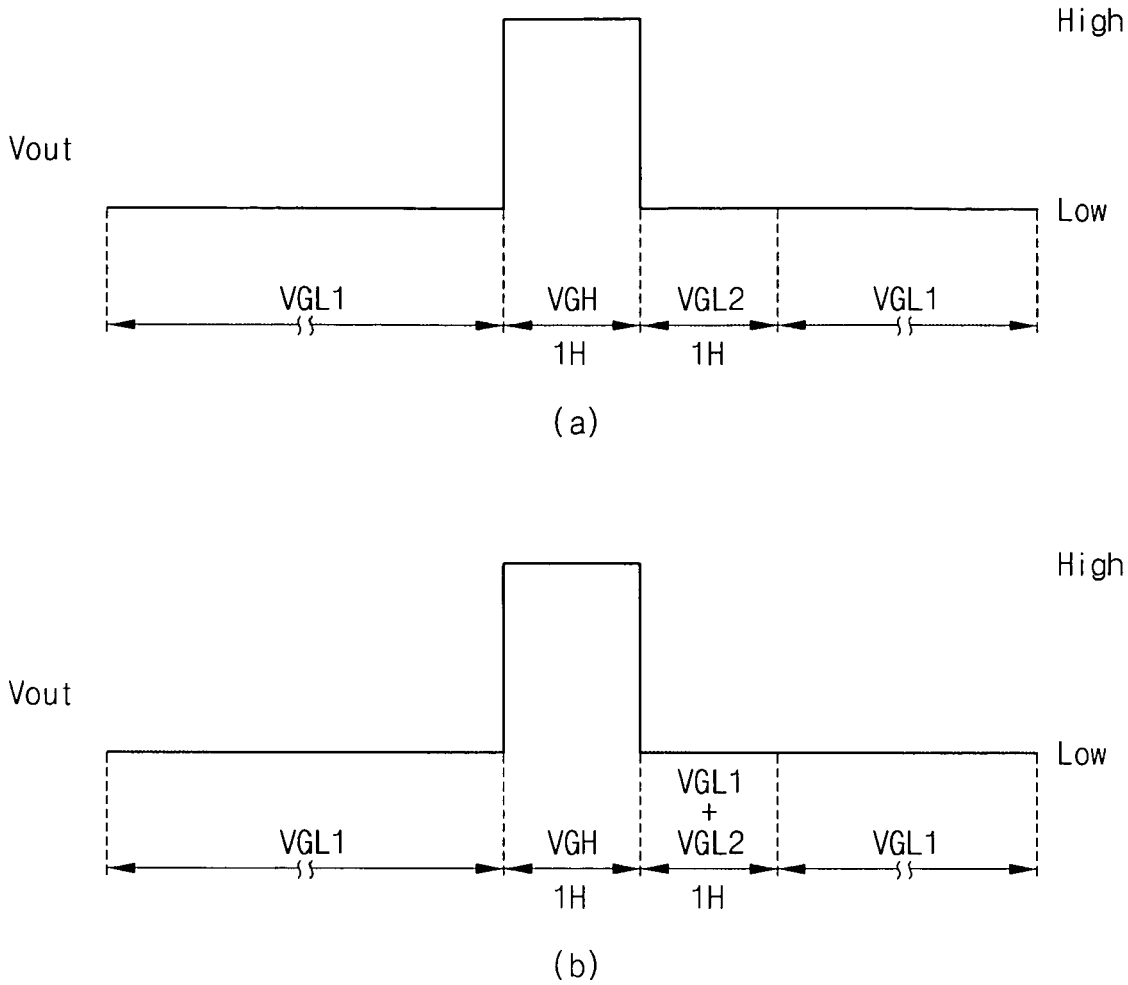
FIG. 5 is waveforms of output voltages from the gate voltage output unit according to the embodiment of the present invention.

FIG. 5 is waveforms of output voltages from the gate voltage output unit according the embodiment to the present invention. In FIG. 5, 1H represents one charging period (one horizontal scanning period).

A first waveform (a) shows an output voltage Vout when the second low-level gate voltage VGL2 is outputted during the $(n+1)^{th}$ charging period, and a second waveform (b) shows an output voltage Vout when the first and second low-level gate voltages VGL1 and VGL2 are simultaneously outputted during the $(n+1)^{th}$ charging period, as described above.

During the charging period of the next gate line, because of the second low-level gate voltage outputted from the buffer, the gate line is supplied with a stable low-level gate voltage, even when the gate line overlaps the pixel electrode of the pixel connected to the next gate line to form the storage capacitor. Further, because the first and second low-level transistors are connected to the same low-level gate voltage LOG line, an additional low-level gate voltage LOG line is not needed. Accordingly, product cost can be reduced, signal delays can be minimized, and the low-level gate voltages can be stably outputted, thereby improving display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

$n^{th}$ and $(n+1)^{th}$ gate lines in a display panel, wherein a pixel electrode of a pixel corresponding to the $(n+1)^{th}$ gate line overlaps the $n^{th}$ gate line; and a gate driver including a gate voltage output unit that outputs an on-level gate voltage and first and second off-level gate voltages to the $n^{th}$ gate line, wherein the on-level gate voltage is outputted during a charging period of the $n^{th}$ gate line, and the second off-level gate voltage is outputted during a charging period of the $(n+1)^{th}$ gate line, wherein the gate voltage output unit includes: an on-level transistor outputting the on-level gate voltage; first and second off-level transistors outputting the first and second off-level gate voltages; and a voltage follower connected to a source terminal of the second off-level transistor, and wherein a source terminal of the first off-level transistor and an input terminal of the voltage follower are commonly connected to an off-level gate voltage LOG (line on glass) line.

2. The device according to claim 1, wherein the first off-level gate voltage is outputted during a frame period excluding time assigned for the charging period of the $n^{th}$ gate line or the charging periods of the $n^{th}$ and $(n+1)^{th}$ gate lines.

3. The device according to claim 1, further comprising a control portion turning on/off the on-level transistor and the first and second off-level transistors.

4. The device according to claim 3, wherein the control portion includes first to third output terminals connected to gate terminals of the on-level transistor and the first and second off-level transistors, respectively.

5. The device according to claim 3, wherein the control portion includes a first output terminal commonly connected to gate terminals of the on-level transistor and the first off-level transistor, and a second output terminal connected to a gate terminal of the second off-level transistor.

6. The device according to claim 3, wherein the control portion is connected to a timing controller.

7. The device according to claim 6, wherein the timing controller generates a plurality of signals that are transferred to the gate driver from a PCB (printed circuit board) via a plurality of LOG lines located along a peripheral portion of the display panel.

8. A method of driving a display device, comprising:

outputting through a gate voltage output unit of a gate driver an on-level gate voltage and first and second off-level gate voltages to a $n^{th}$ gate line which overlaps a pixel electrode of a pixel corresponding to the $(n+1)^{th}$ gate line, wherein the on-level gate voltage is outputted during a charging period of the $n^{th}$ gate line, and the second off-level gate voltage is outputted during a charging period of the $(n+1)^{th}$ gate line, wherein the gate voltage output unit includes: an on-level transistor outputting the on-level gate voltage; first and second off-level transistors outputting the first and second off-level gate voltages; and a voltage follower connected to a source terminal of the second off-level transistor, and wherein a source terminal of the first off-level transistor and an input terminal of the voltage follower are commonly connected to an off-level gate voltage LOG (line on glass) line.

9. The method according to claim 8, wherein the first off-level gate voltage is outputted during a frame period excluding time assigned for the charging period of the $n^{th}$ gate line or the charging periods of the $n^{th}$ and $(n+1)^{th}$ gate lines.

10. The method according to claim 8, further comprising generating the second off-level gate voltage following an off-level gate voltage.

11. The method according to claim 10, wherein the first off-level gate voltage is the off-level gate voltage.

12. The method according to claim 8, further comprising:

generating a gate control signal, a data signal and a data control signal;

generating the on-level gate voltage and first and second off-level gate voltages using the gate control signal; and supplying the data signal to the pixel electrode according to the data control signal during the charging period of the $(n+1)^{th}$ gate line.

13. A liquid crystal display device, comprising:

$n^{th}$ and $(n+1)^{th}$ gate lines in a liquid crystal panel, wherein a pixel electrode of a pixel corresponding to the $(n+1)^{th}$ gate line overlaps the $n^{th}$ gate line; and an on-level transistor inputted with an on-level gate voltage and connected to the $n^{th}$ gate line;

a first off-level transistor inputted with an off-level gate voltage and connected to the $n^{th}$ gate line; and a second off-level transistor inputted with an output voltage of a buffer and connected to the $n^{th}$ gate line, wherein a source terminal of the first off-level transistor and an input terminal of the buffer are commonly connected to an off-level gate voltage LOG (line on glass) line.

14. The device according to claim 13, wherein the on-level transistor is turned on during a charging period of the $n^{th}$ gate line, and the second off-level transistor is turned on during a charging period of the $(n+1)^{th}$ gate line.

15. The device according to claim 14, wherein the first off-level transistor is turned on during a frame period excluding time assigned for the charging period of the $n^{th}$ gate line or the charging periods of the $n^{th}$ and $(n+1)^{th}$ gate lines.

16. The device according to claim 13, wherein the buffer includes a voltage follower inputted with the off-level gate voltage.

17. The device according to claim 13, further comprising a control portion turning on/off the on-level transistor and the first and second off-level transistors.

18. The device according to claim 17, wherein the control portion includes first to third output terminals connected to gate terminals of the on-level transistor and the first and second off-level transistors, respectively.

19. The device according to claim 17, wherein the control portion includes a first output terminal commonly connected to gate terminals of the on-level transistor and the first off-level transistor, and a second output terminal connected to a gate terminal of the second off-level transistor.

20. A driving circuit for a display device, comprising:

a timing controller outputting a gate control signal and an off-level voltage control signal;

an on-level transistor inputted with an on-level gate voltage;

a first off-level transistor inputted with an off-level gate voltage; and a second off-level transistor inputted with an output voltage of a buffer, wherein each of the on-level transistor, the first off-level transistor and the second off-level transistor is turned on according to the off-level voltage control signal, and wherein a source terminal of the first off-level transistor and an input terminal of the buffer are commonly connected to an off-level gate voltage LOG (line on glass) line.

21. The driving circuit according to claim 20, further comprising:

a level shifter receiving the gate control signal; and an output buffer connected to the on-level transistor, the first off-level transistor and the second off-level transistor.

* * * * *